US007259745B2

(12) United States Patent
Hamaguchi

(10) Patent No.: US 7,259,745 B2
(45) Date of Patent: Aug. 21, 2007

(54) METHOD FOR DRIVING ELECTROPHORESIS DISPLAY APPARATUS

(75) Inventor: Atsushi Hamaguchi, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 644 days.

(21) Appl. No.: 10/793,125

(22) Filed: Mar. 3, 2004

(65) Prior Publication Data

US 2004/0222984 A1 Nov. 11, 2004

(30) Foreign Application Priority Data

Mar. 5, 2003 (JP) ..... 2003-058563

(51) Int. Cl.
*G09G 3/34* (2006.01)

(52) U.S. Cl. ..... 345/107; 345/99

(58) Field of Classification Search ..... 345/94, 345/102, 87–100, 147, 107, 204; 365/199; 349/114; 359/296; 348/690
See application file for complete search history.

(56) References Cited

U.S. PATENT DOCUMENTS

| | | | | |
|---|---|---|---|---|
| 3,612,758 | A | 10/1971 | Evans et al. | |
| 6,567,063 | B1 * | 5/2003 | Okita | 345/94 |
| 6,972,815 | B2 * | 12/2005 | Kanbe et al. | 349/114 |
| 2002/0005832 | A1 | 1/2002 | Katase | |
| 2002/0021483 | A1 | 2/2002 | Katase | |
| 2004/0022090 | A1 * | 2/2004 | Hasegawa et al. | 365/199 |

* cited by examiner

*Primary Examiner*—Nitin I. Patel
(74) *Attorney, Agent, or Firm*—Morgan & Finnegan, LLP

(57) ABSTRACT

A method for driving a display apparatus having display memory property is provided. In the method, the display apparatus includes an electrode group composed of at least a first electrode and a second electrode. The method includes the steps of: applying a voltage for performing writing of an display image between the first electrode and the second electrode; and attenuating an absolute value of a potential difference between the first electrode and the second electrode in a term within a holding period of the display image. Thereby, the deterioration of a holding characteristic owing to the influence of a residual DC can be prevented.

5 Claims, 13 Drawing Sheets

METHOD FOR DRIVING ELECTROPHORESIS DISPLAY APPARATUS

BACKGROUND OF THE INVENTION

1. Field of the Invention

The present invention relates to a method for driving a display apparatus having a display memory property.

2. Description of Related Art

As information equipment progresses, demands for display apparatus which consume low electric power and are shaped to be thin are increasing. Accordingly, research and development of display apparatus meeting the demands have been vigorously performed. In particular, a wearable personal computer (PC), an electronic organizer and the like are frequently used outdoors owing to their uses, and then they are expected to be power consumption-saving and space-saving. Accordingly, some products have been developed. Such products, for example, integrate display functions by means of thin type displays such as liquid crystal displays and coordinate inputting processing, and thereby can directly input the contents displayed on the displays by performing pressing operations with pens or fingers.

However, because many liquid crystal displays do not have the so-called display memory properties, it is required to continue to apply voltages to the liquid crystal displays during display periods. On the other hand, it is difficult for the liquid crystal displays having the display memory properties to ensure reliability in the case where uses in various environments such as a use for the wearable PC's are supposed, and consequently the liquid crystal displays having the display memory properties have not been put to practical use yet.

As one of the display systems which have the display memory properties and are formed in thin shapes and light weights, Harold D. Lees et al. proposes an electrophoresis display apparatus in their U.S. Pat. No. 3,612,758. Such a kind of the electrophoresis display apparatus utilizes an electrophoresis phenomenon in which electrophoresis particles are moved by Coulomb forces when an electric field is applied to a fluid dispersion in which the electrophoresis particles are dispersed in a dispersion medium. As one of the electrophoresis display apparatus, there is one having a configuration in which two electrodes, at least one of which is transparent, are opposed to each other with a predetermined gap between them and a fluid dispersion composed of a colored insulating liquid and a plurality of charged migration particles is sealed between the electrodes. When a voltage is applied between the electrodes, the charged migration particles are attracted to one of the electrodes according to the direction of the electric field. Then, an observer can see the color of the insulating liquid or the colors of the charged migration particles.

In such an electrophoresis display apparatus, the charged migration particles attracted to one electrode holds their spatial distribution state when the electric field in the fluid dispersion is made to be uniformly zero. Thus, a display image displayed by the spatial distribution state of the charged migration particles can be held. That is, the display device has the display memory property. Consequently, the electrophoresis display apparatus needs electric power only when display is rewritten, and the electrophoresis display apparatus is considered to be effective for reducing power consumption.

Active matrix system electrophoresis display apparatus utilizing the display memory properties are proposed in US AA2002021483 and US AA2002005832.

According to these proposals, in a reset action period, a reset voltage is written into each pixel electrode. Next, in a write period, a fixed voltage is applied to each pixel electrode for a period in proportion to a gradation value indicated by image data, or a voltage in proportion to a gradation value indicated by image data is applied to each electrode for a fixed period. After that, in a holding action period of a displayed image after a displayed sate has become a substantially desired gradation level, the potential differences between the pixel electrodes and a common electrode are turned to be zero for fixing the spatial distribution state of the electrophoresis particles by turning the electric field applied to the electrophoresis particles to be zero.

However, according to a result of research of the present inventor, in a drive of the conventional electrophoresis apparatus, when the potential differences between the pixel electrodes and the common electrode are abruptly turned to be zero as the holding action, an anti-electric field having a reversed polarity to the write voltage is generated in a liquid layer. When threshold value characteristics of the charged migration particles are insufficient, the charged migration particles are moved by the anti-electric field, and then a desired display state cannot be held. Thus, the conventional electrophoresis apparatus have a problem of an inhibition of the display memory property.

A residual direct current (DC) is regarded as one of the causes of the problem. Hereinafter, the residual DC will be described in detail. In a method of driving the electrophoresis display apparatus, as an example of the drive method is shown in a timing chart of FIG. 3, each of fields having certain time lengths is utilized to perform reset actions, write actions and holding actions for control of image display. The abscissa axis of the graph shown in FIG. 2A is a time axis, and the ordinate axis of the graph is a voltage axis. In FIG. 2A, a solid line indicates an example of a voltage to be applied to a certain pixel of the electrophoresis display apparatus from the outside, and a broken line indicates an effective voltage applied to the fluid dispersion actually at the time of the application of the voltage applied from the outside. Moreover, FIG. 2B shows an optical response at that time. In FIGS. 2A and 2B, a reference mark (A) designates a reset action period, a reference mark (B) designates a write period, and a reference mark (C) designates a holding action period. In the electrophoresis display apparatus, regions having different electrical time constants exist in the device, and electric charges are stored in interfaces between the regions. Consequently, DC components are generated. Generally, the DC components are called as the residual DC's. When the residual DC's are stored, for example, even if the application voltage to a pixel electrode is made to be zero as shown by the solid line in the holding action period as designated by (C) in FIG. 2, an anti-electric field having a reversed polarity to the applied voltage is sometimes generated in the fluid dispersion as shown by the broken line. Because a part of the charged migration particles is written back by receiving the operation of the anti-electric field, the holding of the image is not performed sufficiently.

SUMMARY OF THE INVENTION

The present invention was made for solving the above-mentioned problem, and provides a method for driving a display apparatus having display memory property, the display apparatus including an electrode group composed of at least a first electrode and a second electrode, the method includes the steps of applying a voltage for performing writing of an display image between the first electrode and the second electrode; and attenuating an absolute value of a potential difference between the first electrode and the second electrode in a term within a holding period of the display image.

In the method, an absolute value of a potential difference between a pixel electrode and a common electrode is not turned to zero abruptly at the time of writing/holding action of a display image, but an action for attenuating the absolute value gradually within a fixed period is performed. Thereby, a residual DC is decreased and the generation of an anti-electric field is prevented as much as possible for solving the above-mentioned problem.

By using the drive method disclosed in the present specification, the deterioration of holding owing to the influence of the residual DC can be prevented at the time of a holding action for holding a display image of an electrophoresis display apparatus.

DESCRIPTION OF THE PREFERRED EMBODIMENTS

In the following, the attached drawings will be referred to while the preferred embodiments of the present invention are described by exemplifying the application of the invention to an electrophoresis display apparatus, one of the display apparatus having the display memory properties. The present invention is not limited to the application of the electrophoresis display apparatus, but can be applied to the other display apparatus having the display memory properties, such as a toner display (IEICE Technical Report EID 99-154, p7 (2000), Chiba University), Gyricon (SID '77 Digest, p114, XEROX Corporation), and the like. Incidentally, descriptions will be given on the supposition that a first electrode (an expression in claims) is a pixel electrode and a second electrode (an expression in claims) is a common electrode.

Figure 1A:
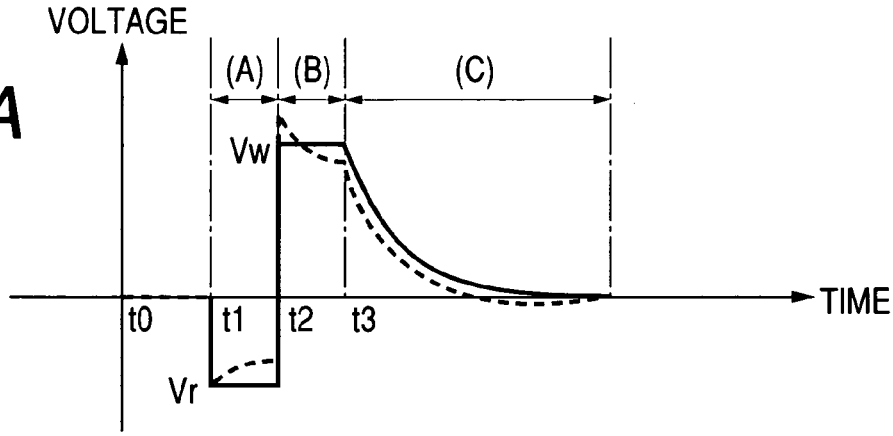
FIGS. 1A and 1B are graphs showing correlations among an external application voltage, an effective voltage to a fluid dispersion, and an optical response at each action period in the present invention.
Figure 1B:
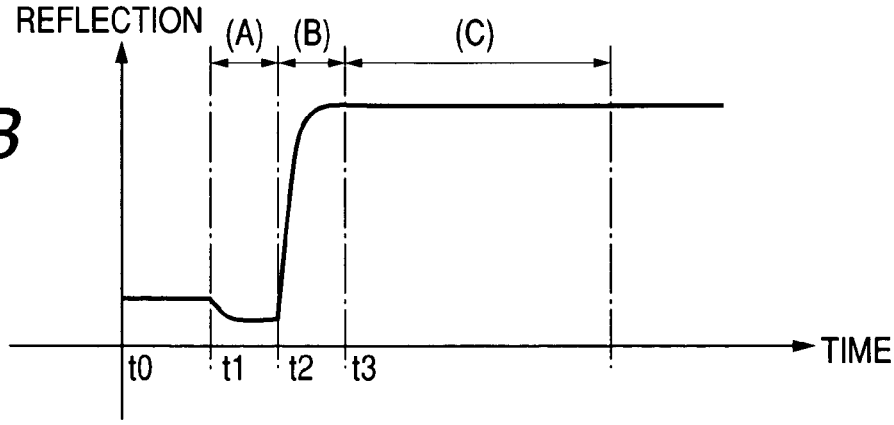
Figure 2A:
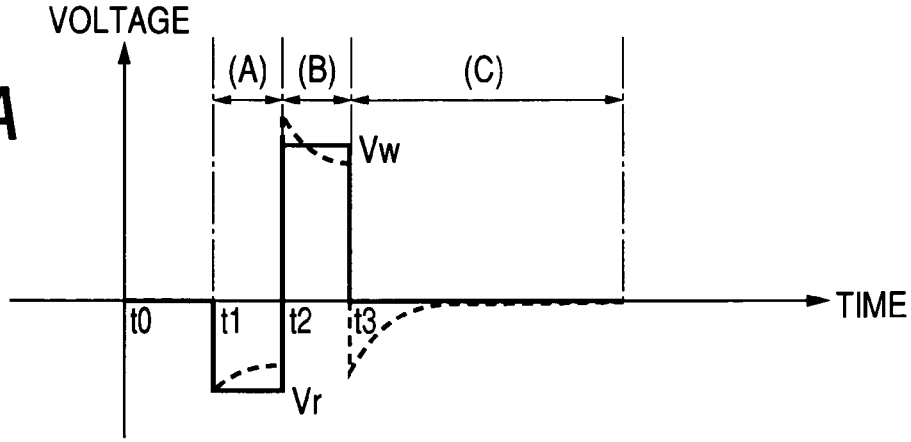
FIGS. 2A and 2B are graphs showing correlations among an external application voltage, an effective voltage to a fluid dispersion, and an optical response at each action period in a conventional apparatus.
Figure 2B:
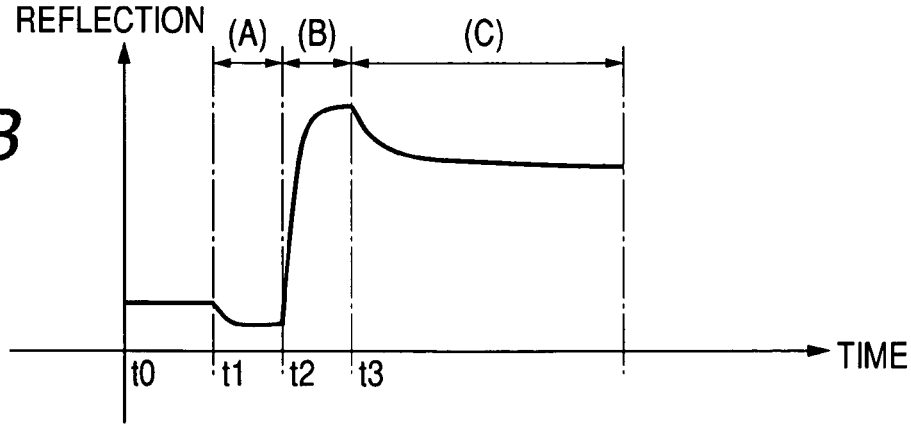
Figure 3:
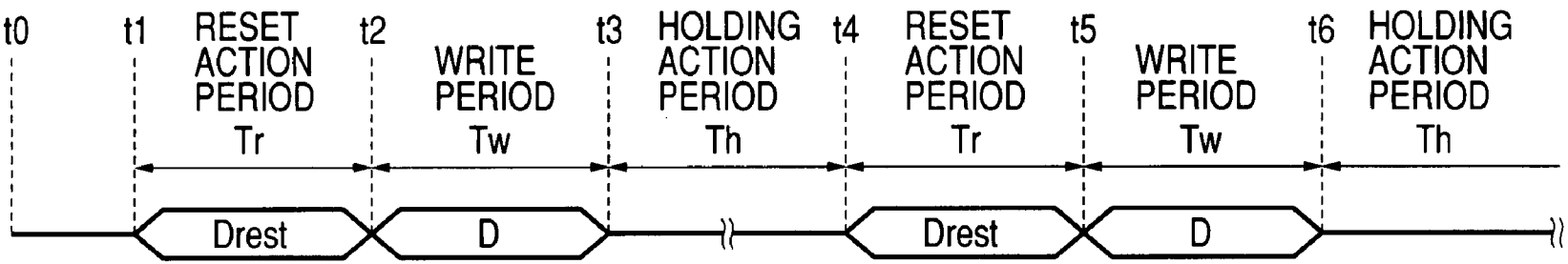
FIG. 3 is a timing chart showing each action period.

The abscissa axis of FIG. 1A is a time axis, and the ordinate axis of FIG. 1A is a voltage axis. In FIG. 1A, a solid line indicates an example of a voltage to be applied to a certain pixel of an electrophoresis display apparatus from the outside, and a broken line indicates an effective voltage actually applied to a fluid dispersion at that time. Moreover, FIG. 1B shows an optical response at that time. In FIGS. 1A and 1B, a reference mark (A) designates a reset action period, a reference mark (B) designates a write period, and a reference mark (C) designates a holding action period. In the period precedent to the reset action period (A), it can be considered that a display state performed at the last time is shown. In the reset action period (A) after the time t1 has passed, a reset voltage Vr is applied to the pixel to reset the display performed at the last time. Then, in the write period (B) after the time t2 has passed, a write voltage Vw is applied to the pixel to drive the device for performing display at a desired gradation level. The control of the gradation level is performed by a pulse width modulation or an amplitude modulation of the write voltage Vw. The gradation level can be controlled by an application time of the write voltage Vw in case of the execution of the pulse width modulation, or by the magnitude of the write voltage Vw in case of the execution of the amplitude modulation of the write voltage Vw. Next, in the holding action period (C) after the time t3 has passed, holding is performed by controlling the electric potential of the first electrode or the electric potential of the second electrode for turning the electric field acting on the particles to be zero. At this time, for avoiding the operation of a residual DC as an anti-electric field, the potential difference between the first electrode and the second electrode is not made to drop to zero abruptly, but the absolute value of the potential difference between the first electrode and the second electrode is gradually attenuated within a fixed term. Thereby, the generation of the anti-electric field is suppressed as much as possible, and the holding characteristic is improved. By the holding action, the optical response is held to be constant during the holding action period (C) and after the period (C) in FIG. 1B.

Figures 4A, 4B, 4C:
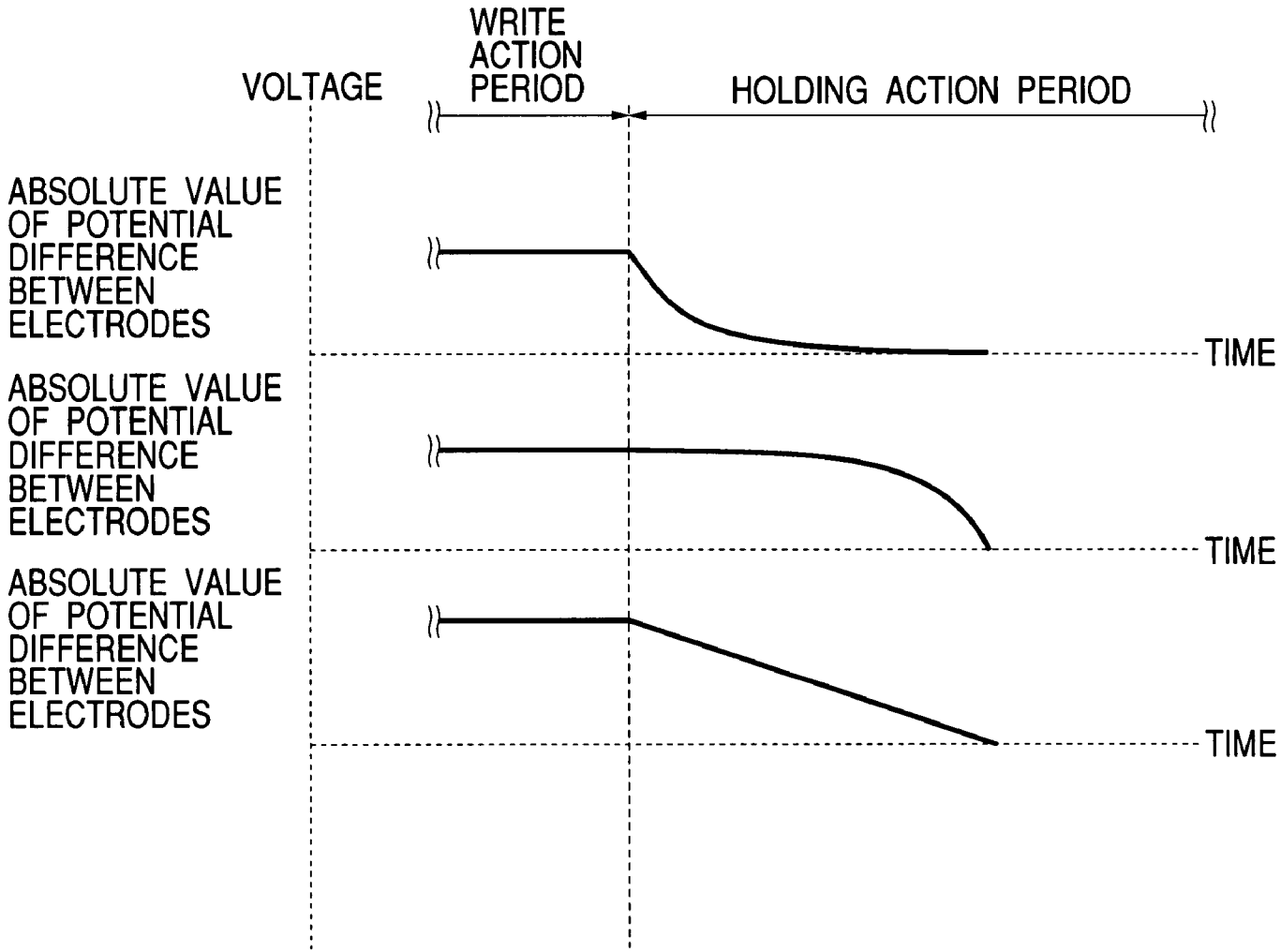
FIGS. 4A, 4B and 4C are views showing examples of methods for attenuating absolute values of electric potential differences.

FIGS. 4A to 4C will be referred to while examples of methods for attenuating the absolute value of the potential difference between the first electrode and the second electrode gradually within the fixed term for suppressing the anti-electric field is described. In FIGS. 4A to 4C, the abscissa axes are time axes, and the ordinate axis shows absolute values of potential differences between the first electrode and the second electrode. The attenuation method may be one for suppressing the anti-electric field. For example, a logarithmic function-like attenuation method (in FIG. 4A), an exponential function-like attenuation method (FIG. 4B), a linear attenuation method (FIG. 4C) and the like can be cited.

In the following, a drive method according to the present invention will be described by exemplifying an active matrix method using TFT's as switching devices connected to respective pixels of the electrophoresis display apparatus. However, the drive method according to the present invention for attenuating the absolute values of the potential differences between the first electrodes and the second electrode gradually within the fixed period at a holding action time is not limited to the active matrix method using the TFT's, but can be also applied to the other active matrix methods using the other switching devices such as thin film diodes (TFD's), a segment method, and a simple matrix method.

Incidentally, the drive method of the present invention can be applied to both of a vertically migrating type electrophoresis display apparatus and a horizontally migrating type electrophoresis display apparatus.

Moreover, in the present invention, the charged migration particles and the dispersion media may be encapsulated in each of many micro-capsules.

Moreover, the present invention is not limited to the case where the holding action of a display image is performed after a display state has substantially reached a desired gradation level and the write actions to all of the pixels have been completed, but also is effective to a case where a holding action is started before the completion of the write actions, namely, to a case where desired write actions are terminated while an attenuation waveform is being applied.

In the following, the attached drawings will be referred to while the drive method of the present invention is described in accordance with the preferred embodiments in further detail.

Embodiment 1

An electrophoresis display apparatus includes an electrophoresis display panel in which pixels and switching devices are arranged in a matrix composed of m rows and n columns, and peripheral equipment for driving the pixels by applying voltages to m rows of scanning lines and n columns of data lines through the switching devices. In the present embodiment, descriptions will be given to a display apparatus having 10 rows (m=10) and 20 columns (n=20). Each pixel has a size of 200 μm square.

Figure 5:
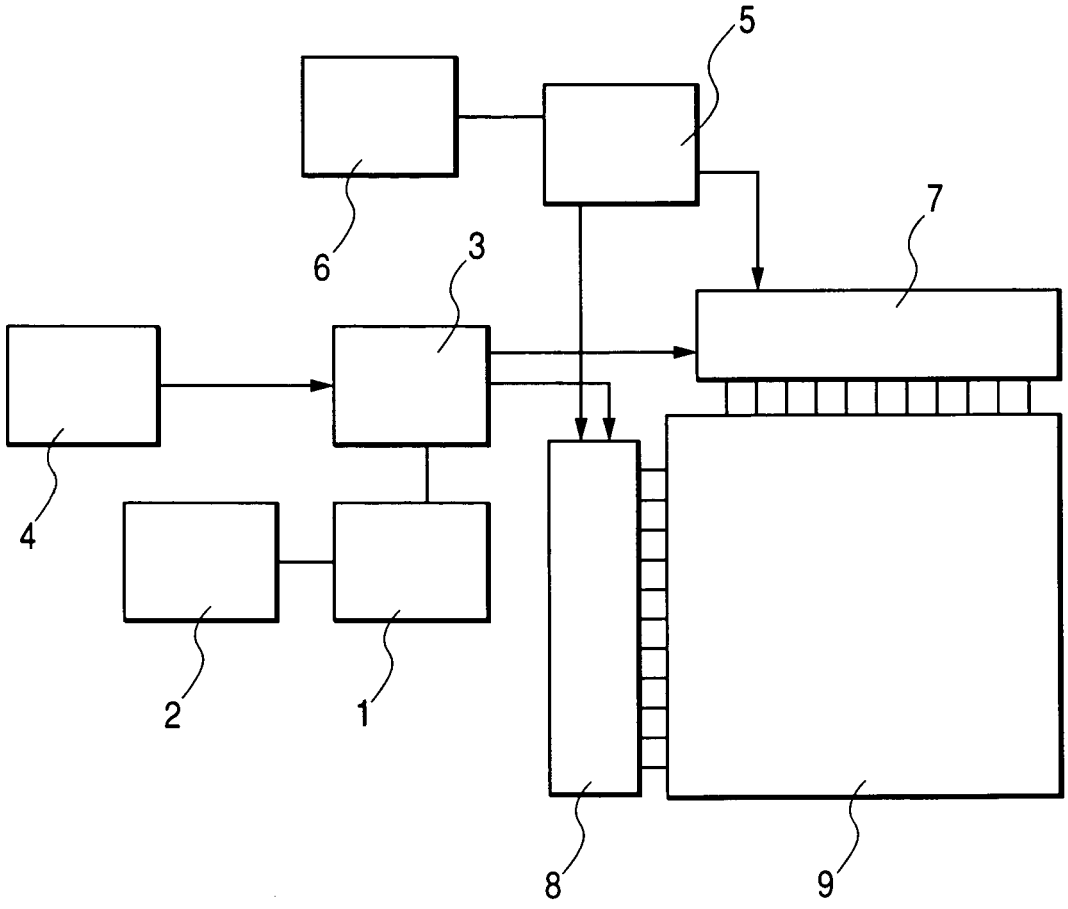
FIG. 5 is a block diagram showing an electrophoresis display apparatus and its peripheral circuits.

FIG. 5 is a block diagram showing an example of the configuration of the electrophoresis display apparatus according to the present invention. The electrophoresis display apparatus is composed of a graphic controller 1, a graphic memory 2, a panel controller 3, a central processing unit (CPU) 4, a power source unit 5, a power control unit 6, a data line drive circuit 7, a scanning line drive circuit 8 and the electrophoresis display panel 9.

In operation, the graphic controller 1 inputs image data stored in the graphic memory 2 into the panel controller 3 in accordance with an information transfer clock.

Moreover, the panel controller 3 generates control signals such as a field synchronizing signal, a horizontal synchronizing signal and a data capturing clock, and display data in accordance with the image data input from the graphic controller 1, and then the panel controller 3 transmits the generated signals and data to the data line drive circuit 7 and the scanning line drive circuit 8.

The data line drive circuit 7 and the scanning line drive circuit 8 outputs drive voltages to the electrophoresis display panel 9 in accordance with the control signals and the display data received from the panel controller 3, and thereby performs the display of the electrophoresis display panel 9.

Moreover, the power source unit 5 is a unit for supplying electric power to each block. Execution and a stop of power supply of the power source unit 5 are controlled by the power control unit 6. The power control unit 6 operates on the basis of a power switch state signal input according to the turning on or off of a power switch of the electrophoresis display apparatus.

Figure 6:
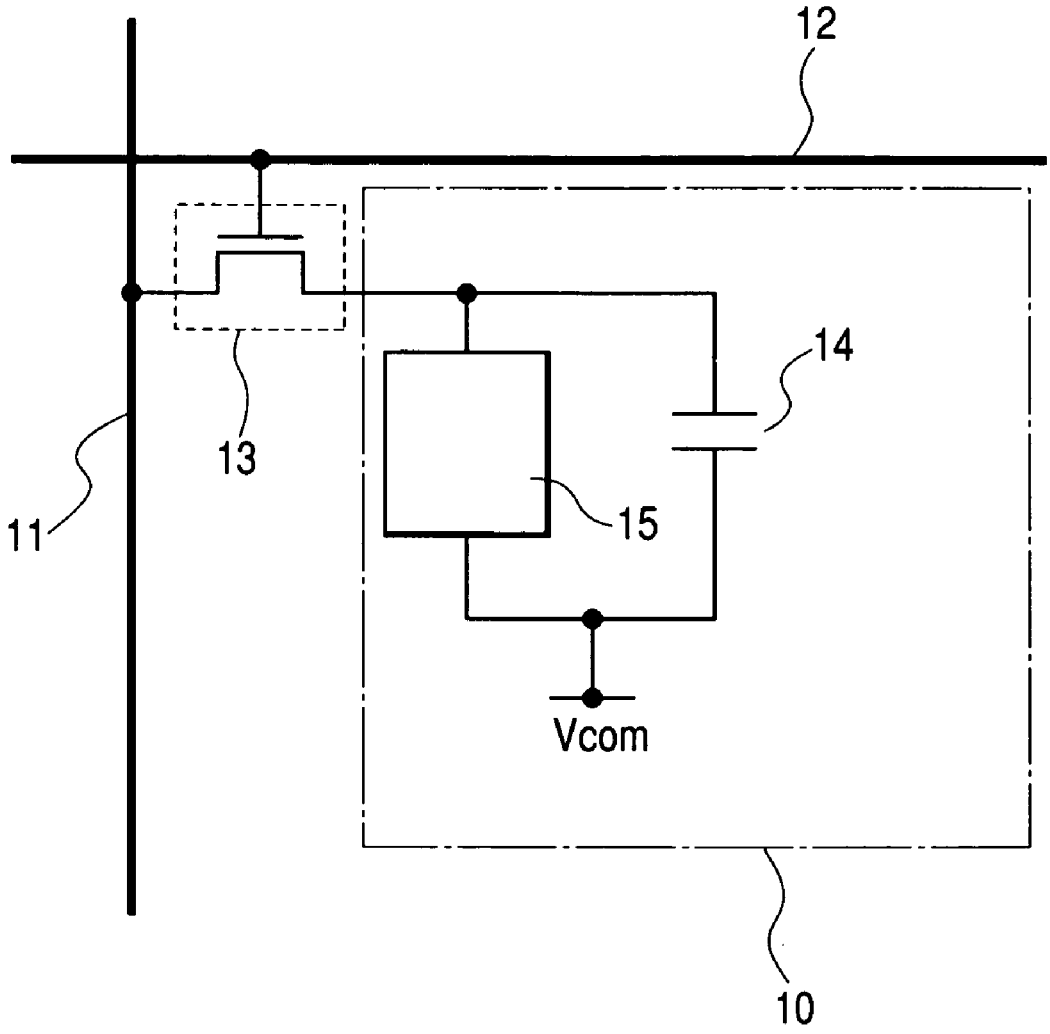
FIG. 6 is a circuit diagram showing an electrophoresis display device and a thin film transistor (TFT) of one pixel.

A schematic diagram of a pixel of the electrophoresis display panel 9 is shown in FIG. 6. A first electrode of an electrophoresis display device 15 is connected to a drain electrode of a thin film transistor 13 (hereinafter referred to as TFT 13) for active matrix drive display. A second electrode of the electrophoresis display device 15 is connected to a common electrode having a voltage Vcom. The second electrodes of all of the pixels are connected to the common electrode. Moreover, an auxiliary capacitor 14 is also connected to the common electrode. A data line 11 is connected to a source electrode of the TFT 13, and a scanning line 12 is connected to a gate electrode of the TFT 13.

Figure 7:
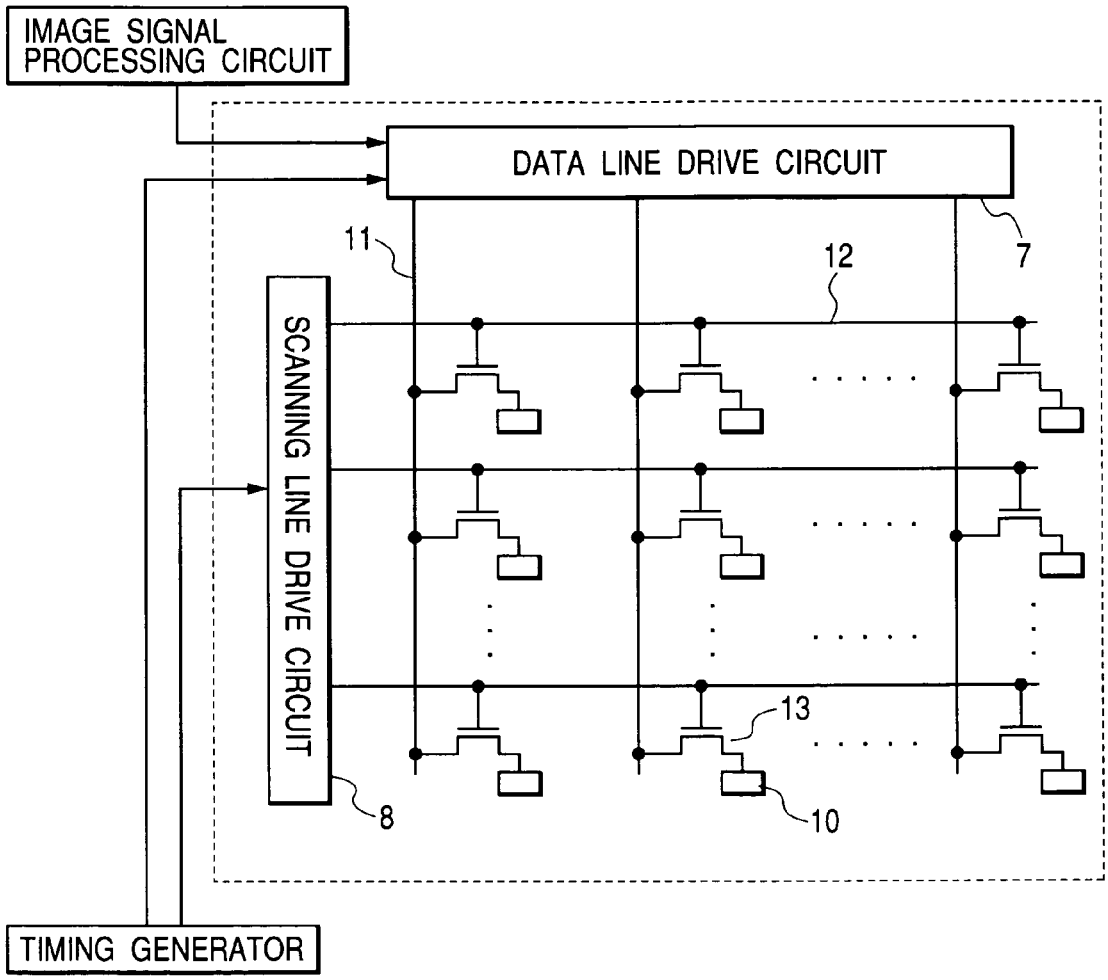
FIG. 7 is a schematic diagram showing an electrophoresis display panel and its drive circuits.

FIG. 7 will be referred to while a reset action is described in detail. A case where TFT's including m rows of the scanning lines 12 and n columns of the data lines 11 are used for controlling the pieces of electric potential of the pixel electrodes of electrophoresis display devices which are composed of m rows and n columns and are connected to the TFT's respectively will be examined. Hereupon, a pixel arranged at the ith row and at the jth column is designated as a pixel Pij. First, in a state in which a gate voltage corresponding to the off voltage of the TFT is applied to the scanning lines 12 of all of the rows, a reset voltage Vr is applied to the data lines 11 of all of the columns. After that, a gate voltage corresponding to the on voltage of the TFT is applied to the scanning lines 12 of all of the rows. After a spatial distribution state of the charged migration particles in the fluid dispersion has been initialized up to a substantially sufficient level, the gate voltage corresponding to the off voltage of the TFT is applied to the scanning lines 12 of all of the rows. Thus, the reset action has been completed.

Figure 8:
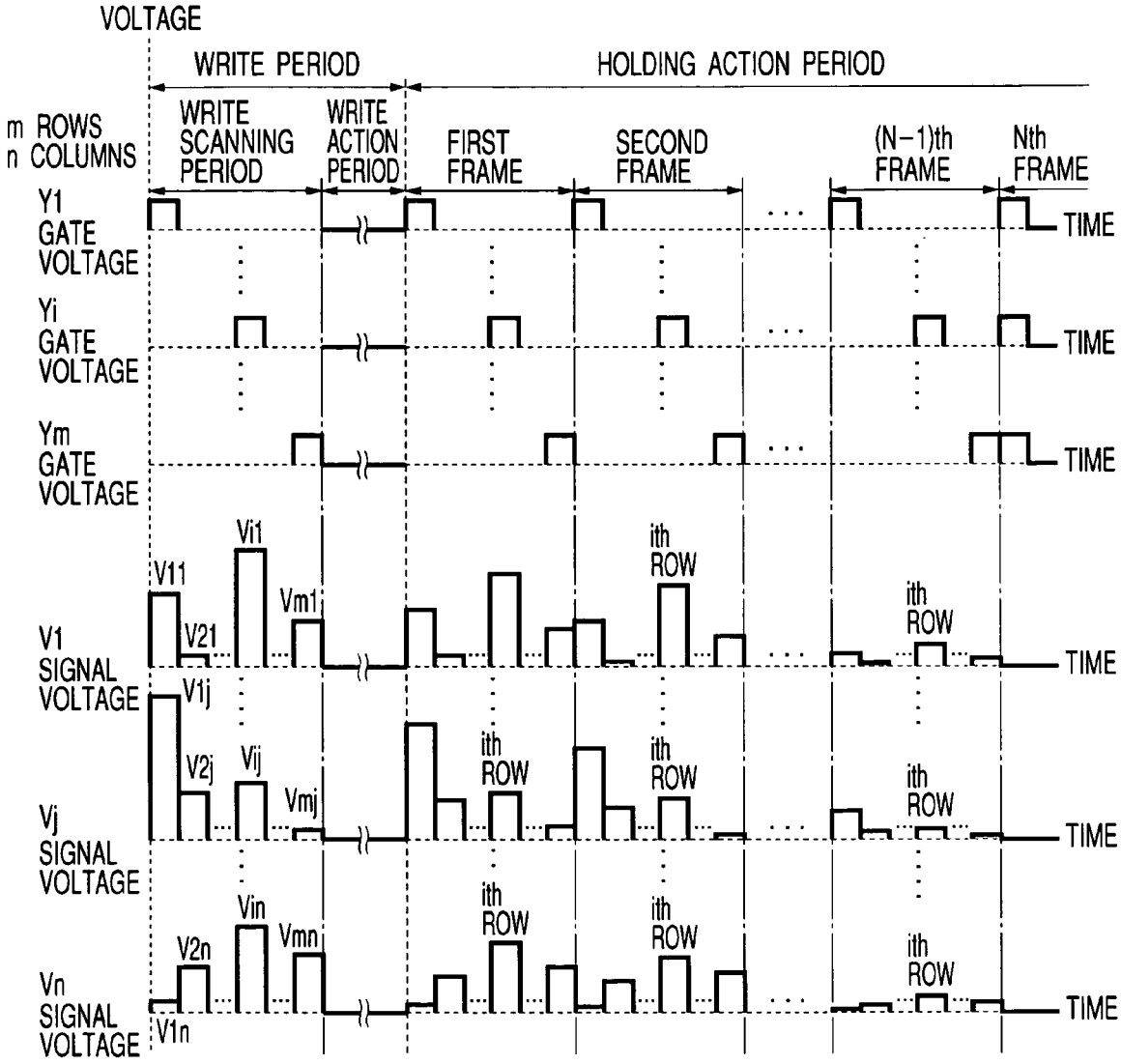
FIG. 8 is a timing chart showing examples of gate voltages and signal voltages in a write period and a holding action period when absolute values of potential differences are attenuated over a plurality of frames.
Figure 9:
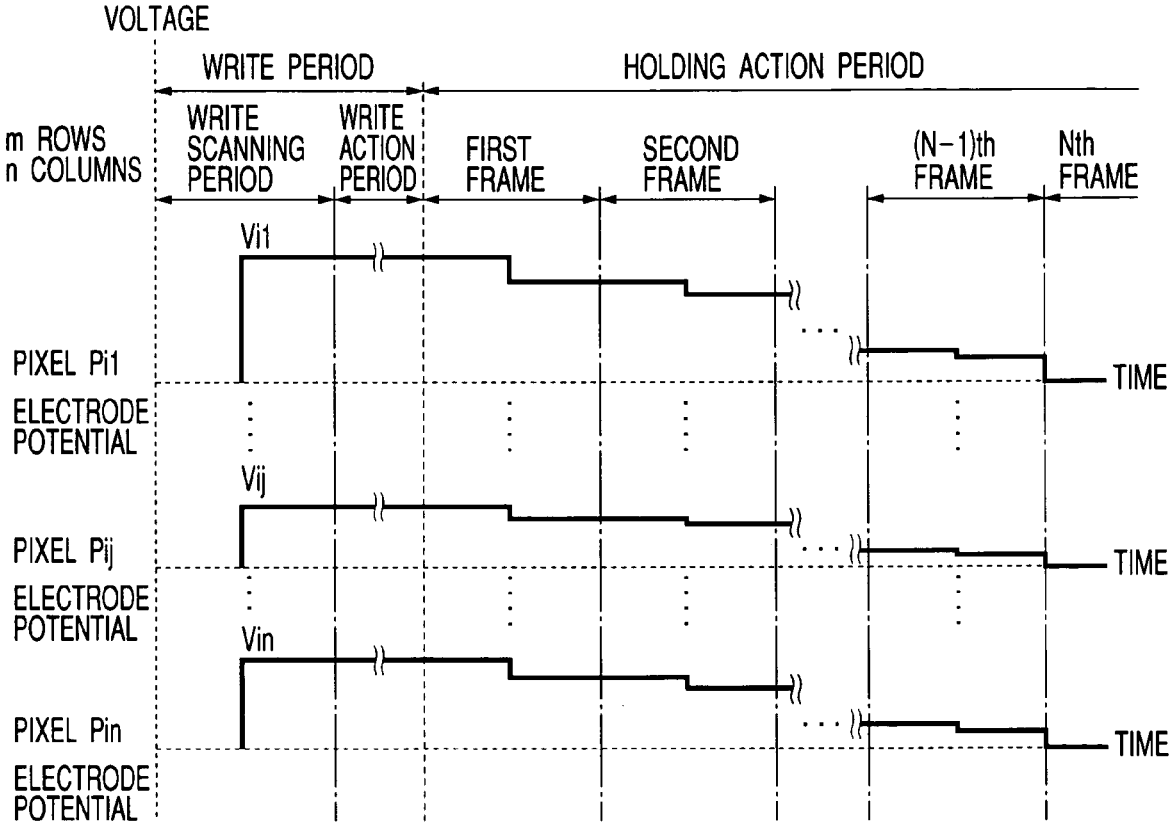
FIG. 9 is a timing chart showing electric potential of each pixel electrode to which the gate voltage and the signal voltage shown in FIG. 8 are applied.

Next, FIGS. 7, 8 and 9 will be referred to while a write action is describe in detail. Incidentally, FIGS. 7, 8 and 9 are schematic views, and relations among the lengths of a write period, a write scanning period, a write action period and a holding action period do not necessarily reflect the magnitude relations at the time of an actual drive accurately. A case where the TFT's including the m rows of the scanning lines 12 and the n columns of the data lines 11 are used for controlling the electric potential of the pixel electrodes of the electrophoresis display devices which are composed of the m rows and the n columns and are connected to the TFT's respectively will be examined. As described above, in the present embodiment, the number of the rows m is 10 (m=10), and the number of the columns n is 20 (n=20).

In FIGS. 8 and 9, abscissa axes are time axes, and ordinate axes are voltage axes. FIG. 8 shows a gate voltage Yi of the ith row and a signal voltage Vj of the jth column. FIG. 9 shows the electric potential Vij of a pixel electrode when the gate voltage Yi and the signal voltage Vj are applied to a pixel Pij at the ith row and at the jth column. First, a gate voltage Y1 corresponding to the on voltage of the TFT is applied only to the scanning line at the first row, and the gate voltage corresponding to the off voltage of the TFT is applied to the other scanning lines. In this sate, signal voltages V11-V1*n* corresponding to desired gradation levels to respective pixels at the first row are applied to the respective data lines.

The voltages to be applied to the gate lines are −5 V at the time of off, i.e. in a not selected state, and 40 V at the time of on, i.e. in a selected state. The peak-to-peak values of the pulses are 45 V. Moreover, an application time of a selection pulse is 20 μs. The signal voltages to be applied to the data lines are changed according to images within a range of from 0 V to 20 V.

Next, in the state in which the gate voltage corresponding to the off voltage of the TFT is applied to the scanning lines of all of the rows, signal voltages V21-V2*n* corresponding to desired gradation levels to respective pixels at the second row are applied to respective data lines. After that, a gate voltage Y2 corresponding to the on voltage of the TFT is applied only to the scanning line at the second row.

After that, similar actions are repeated until the scanning to the mth row has been completed. Because the selection time of each scanning line is 20 μs and the number of the scanning lines is 10 (m=10), a necessary period of the write scanning is 200 μs.

When a time is necessary after the completion of the write scanning until the migration particles reach equilibrium positions, writing is not performed for the necessary time. A write action period immediately after the write scanning period in FIG. 8 indicates the necessary period. In the electrophoresis display apparatus of the present embodiment, the write action period is 500 ms.

Next, FIGS. 7, 8 and 9 will be referred to while a holding action is described in detail. At the time of a holding action of a display image after the display state substantially has reached the desired gradation level during the write action period and the writing to all of the pixels has been completed, as shown in FIGS. 8 and 9, absolute values of the potential differences between the first electrodes and the second electrode are gradually attenuated over a plurality of frames. In the present embodiment, the attenuation of the absolute values of the potential differences between the first electrodes and the second electrode is performed over 10 frames (N=10). In the following, the pixel at the ith row and at the jth column is designated by the reference mark Pij.

In FIG. 8, at the time of the completion of the write period, namely at the time point at which the write scanning period and the write action period after the write scanning period have been completed, the display state substantially reaches the desired gradation level. After that, the image is held for a period until the next writing is performed, namely for a period during which the holding action is performed, because the electrophoresis display apparatus has the memory property. In the present embodiment, there is provided an attenuation voltage application period for attenuating the electric potential of the pixel electrodes gradually over a plurality of frames with regard to a display image after the write actions to all of the pixels have been completed.

The application pulses and their periods in each frame are similar to those in the write scanning period, but the signal voltages to be applied to the data lines 11 are made to be smaller than those in the write scanning period, and the values of the signal voltages are made to be smaller gradually as the number of the frames increases.

In the following, the actions during the attenuation voltage application period will be described more concretely.

First, actions in the first frame will be described. The gate voltage corresponding to the on voltage of the TFT is applied to the scanning line at the fist row, and the gate voltage corresponding to the off voltage of the TFT is applied to the other scanning lines. At the same time, voltages having magnitudes of 90% of the values of the signal voltages corresponding to respective gradation values, which voltages have been applied to the respective pixels at the first row, are applied to respective data lines. After that, the scanning lines up to the scanning line at the mth row are sequentially selected by applying the gate voltages corresponding to the on voltage to the scanning lines similarly while applying the voltages having the magnitudes of 90% of the voltage values applied to the respective pixels during the write scanning period to the respective pixels through respective data lines. At the completion of the application of the voltages to the respective pixels, the actions in the first frame are terminated.

In the second frame, voltages having the magnitudes of 80% of the signal voltage values during the write scanning period are applied to respective pixels.

After that, the frame actions are repeated similarly. In the ninth frame, voltages having the magnitudes of 10% of the signal voltage values during the write scanning period are applied to the respective pixels. In the last tenth frame, voltages having the magnitudes of 0 V are applied to the respective pixels.

As described above, the ratios of the attenuation of the voltages are determined in order that the sufficient attenuation of the voltages may be completed by the (N−1)th frame, and the electric potential of all of the pixels is made to be zero in the Nth frame. By performing the action of the attenuation voltage application, the residual DC is decreased, and no influence of the residual DC voltage is exerted on the next write scanning. That is, a desired display state is written in without being influenced by the preceding display.

The method described above is a method of performing attenuation actively. That is, because voltages are applied in respective frames in the active matrix drive and the application voltages are attenuated gradually, arbitrary attenuation methods can be adopted by setting the voltages at every frame suitably.

By the method shown above, the influence of the residual DC can be reduced at the holding action of a display image of the electrophoresis display apparatus, and thereby display characteristics are improved.

Embodiment 2

After the completion of the reset action and the write action in the embodiment 1, the holding action is performed as follows.

Figure 10:
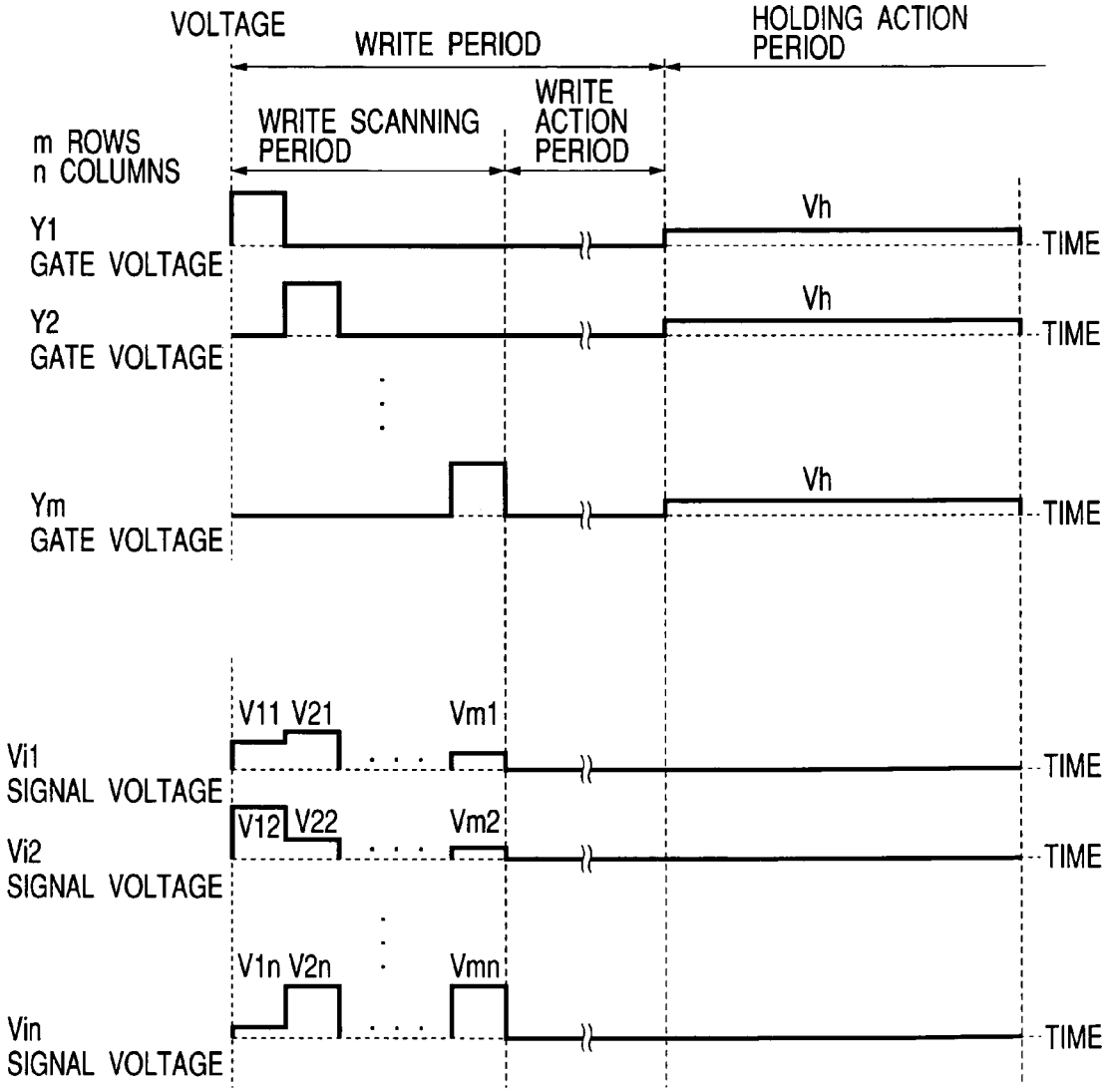
FIG. 10 is a timing chart showing examples of the gate voltages and the signal voltages in a write period and a holding action period when the absolute values of the potential differences are gradually attenuated.
Figure 11:
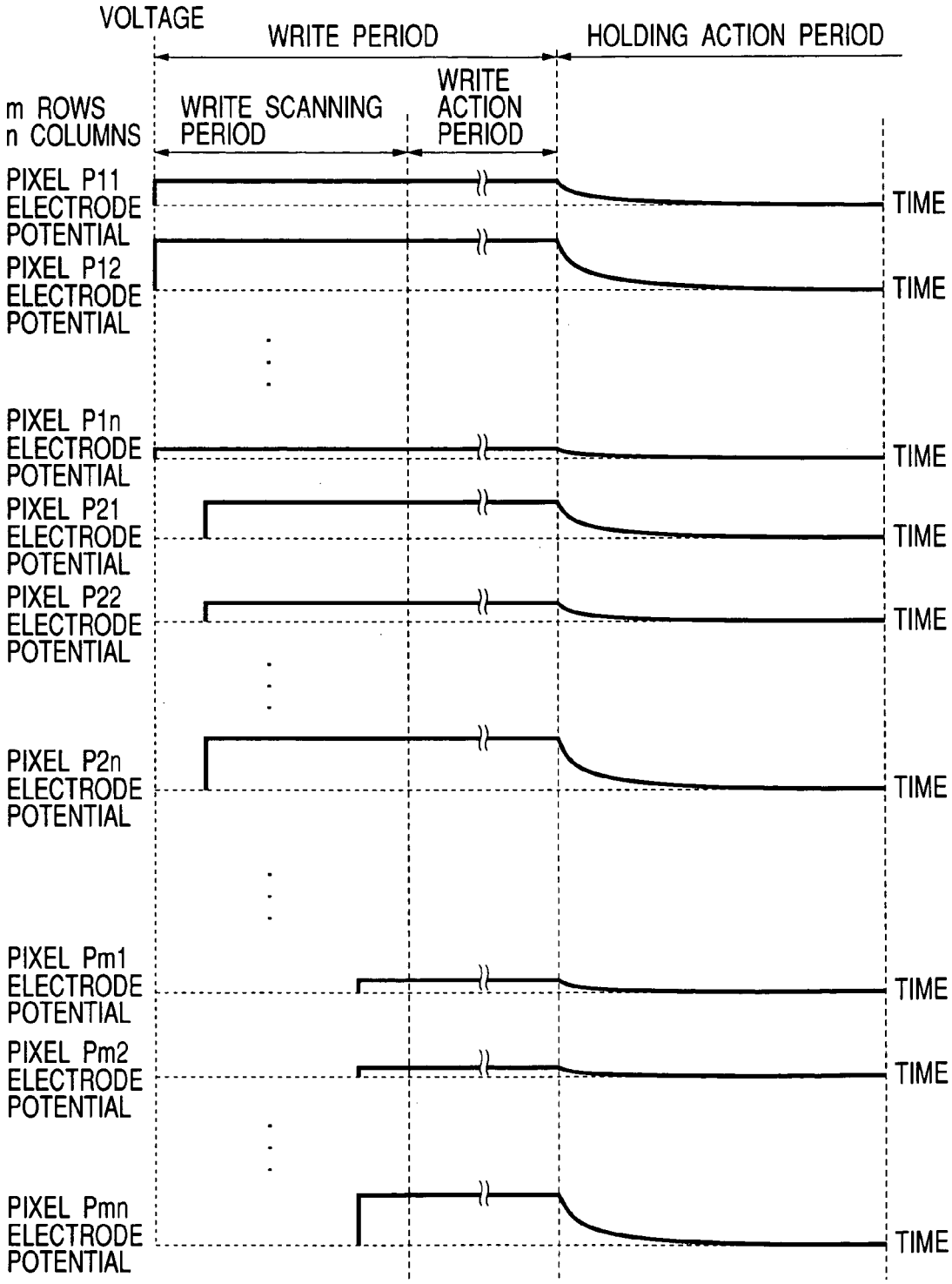
FIG. 11 is a timing chart showing electric potential of each pixel electrode to which the gate voltage and the signal voltage shown in FIG. 10 are applied.

FIGS. 7, 10 and 11 will be referred to while the holding action is described in detail. Incidentally, FIGS. 7, 10 and 11 are schematic views, and relations among the lengths of a write period, a write scanning period, a write action period and a holding action period do not necessarily reflect the magnitude relations at the time of an actual drive accurately. A case where the TFT's including the m rows of the scanning lines and the n columns of the data lines are used for controlling the electric potential of the pixel electrodes of the electrophoresis display devices which are composed of the m rows and the n columns and are connected to the TFT's respectively will be examined. Hereupon, a pixel at ith row and at jth column is designated by the reference mark Pij.

FIG. 10 is a diagram showing gate voltages and signal voltages. Abscissa axes indicate time axes. Ordinate axes indicate voltage axes. The ith gate voltage is designated by the reference mark Yi, and a signal voltage input into the pixel Pij is designated by a reference mark Vij. Moreover, FIG. 11 shows the electric potential of each pixel electrode when the gate voltages and the signal voltages are applied to the respective pixels as shown in FIG. 10 at a write time and at a holding action time.

The actions in the write period are the same as those in the embodiment 1. At the time point of the termination of the write period, the display state substantially reaches the desired gradation level.

The present embodiment causes current leakage through switching devices during a certain period in the holding action period, and thereby attenuates the electric potential of the pixel electrodes gradually.

To put it concretely, a certain fixed voltage Vh larger than the off voltage and smaller than the on voltage is applied to the gate electrodes of the TFT's at the scanning lines of all of the rows, and thereby leak currents are made to flow between the drains and the sources of the TFT's. Consequently, the attenuation of the absolute values of the potential differences between the first electrodes and the second electrode is performed faster than the attenuation in a case of according to a time constant at the time of off of the TFT and slower than the attenuation in a case of according to a time constant at the time of on of the TFT.

A voltage which is smaller than the on voltage but causes an action of a transistor almost near to its on state is applied to the gate electrode of each transistor, and thereby a little current flows in each transistor to discharge the charges stored in respective pixels. In the present embodiment, the gate on voltage of the transistor is 40 V, and the gate off voltage of the transistor is −5V, and further the voltage Vh is 38 V.

By the method described above, the influence of the residual DC at a time of a holding action of a display image of an electrophoresis display apparatus can be decreased similarly to the embodiment 1, and thereby the holding characteristic can be improved.

Embodiment 3

Figure 12:
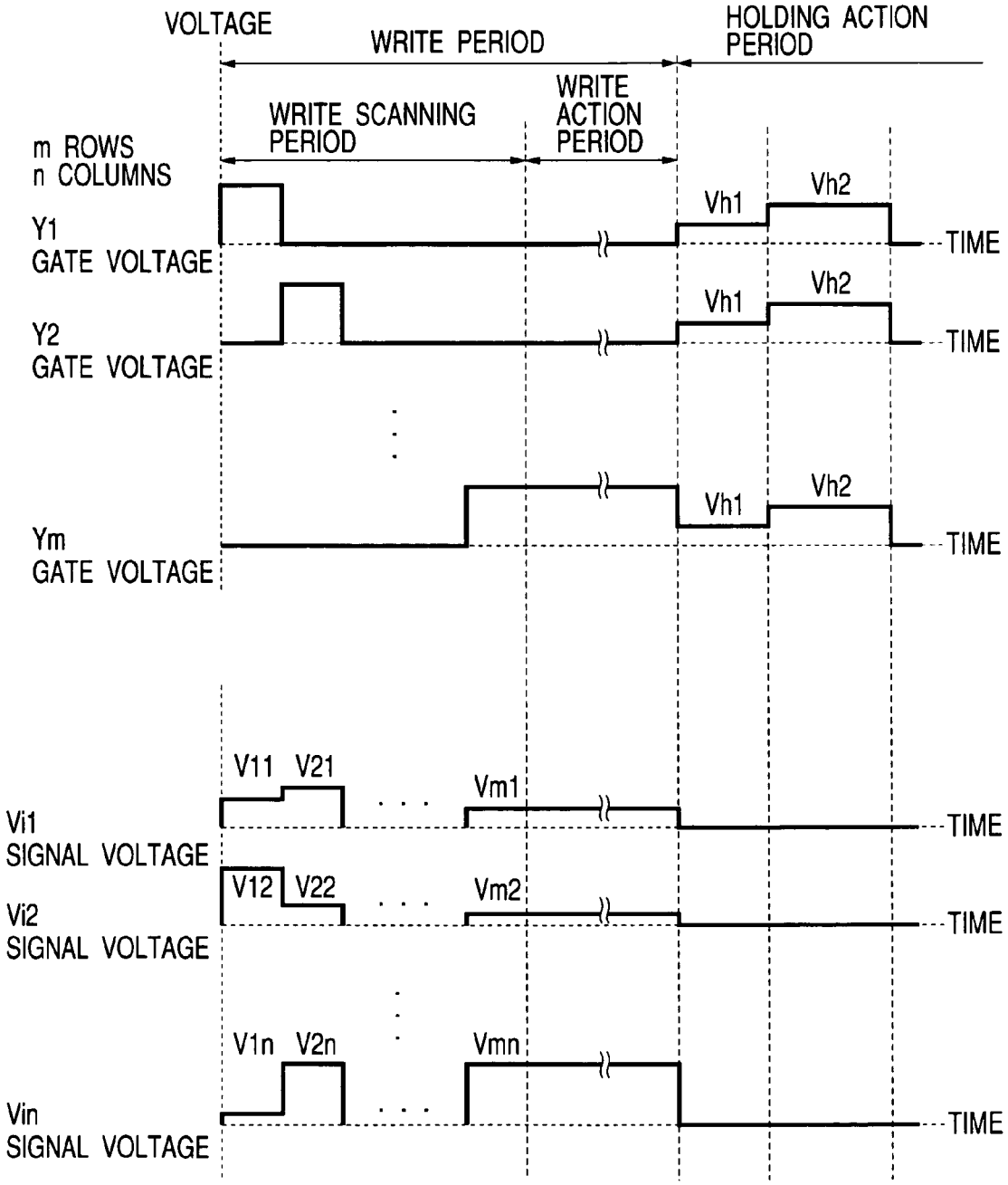
FIG. 12 is a timing chart showing examples of the gate voltages and the signal voltages in a write period and a holding action period when the absolute values of the potential differences are attenuated in accordance with a two-step or more attenuation condition.
Figure 13:
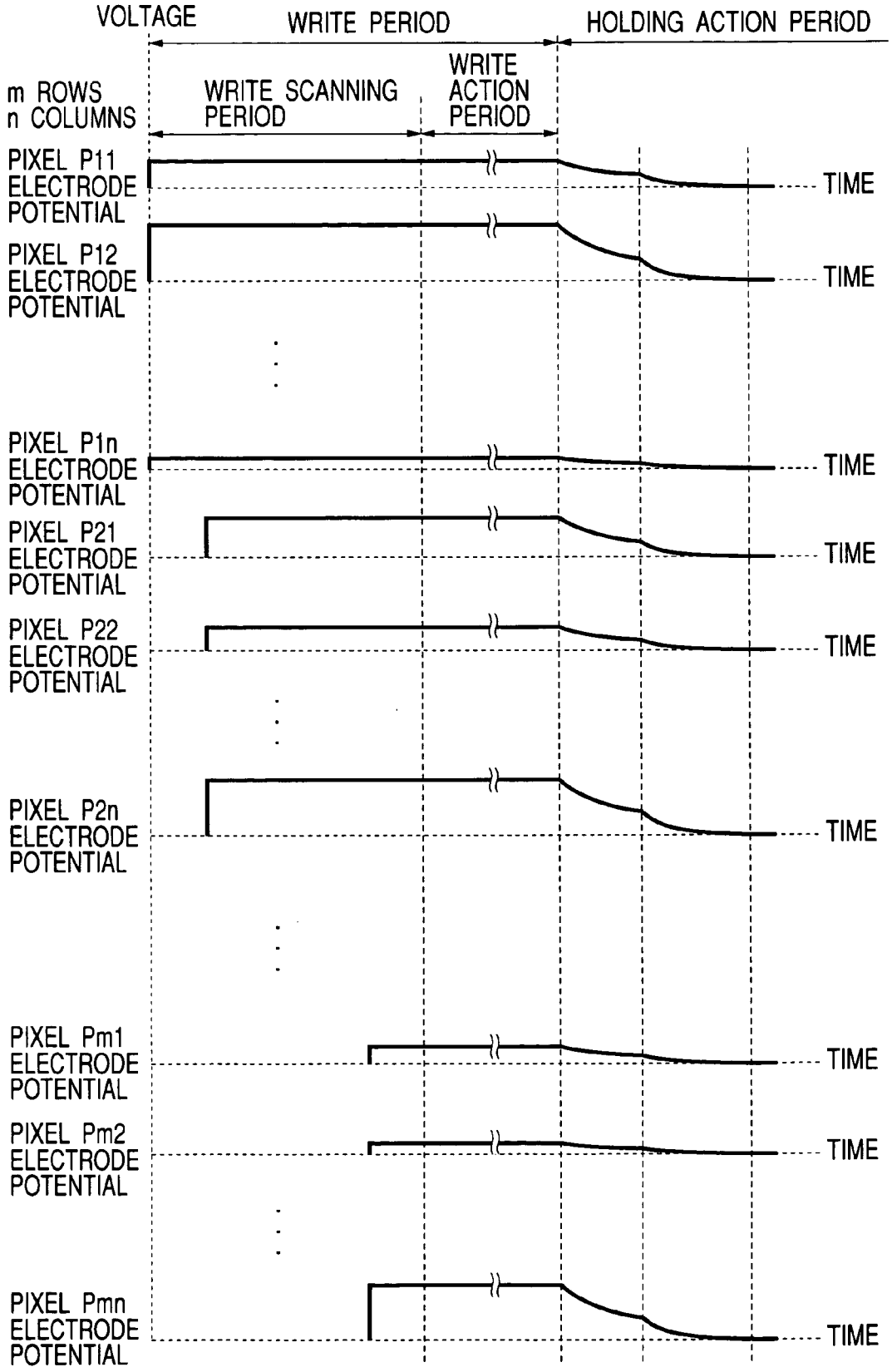
FIG. 13 is a timing chart showing examples of the electric potential of respective pixel electrodes when the absolute values of the potential differences are attenuated in accordance with the two-step or more attenuation condition.

When the holding action period in a holding action in the embodiment 2 is desired to be completed faster, for example, when a decrease of consumption power is desired and accordingly a power feed time from a power source in the holding action period is desired to be shortened, an attenuation condition having desired two steps or more is set, and the attenuation of the absolute values of the potential differences between the first electrodes and the second electrode is performed in accordance with the attenuation condition. FIGS. 7, 12 and 13 will be referred to while the description of the present embodiment is given. Incidentally, FIGS. 7, 12 and 13 are schematic views, and relations among the lengths of a write period, a write scanning period, a write action period and a holding action period do not necessarily reflect the magnitude relations at the time of an actual drive accurately. A case where the TFT's including the m rows of the scanning lines and the n columns of the data lines are used for controlling the electric potential of the pixel electrodes of the electrophoresis display devices which are composed of the m rows and the n columns and are conned to the TFT's respectively will be examined. Hereupon, a pixel at the ith row and at the jth column is designated by the reference mark Pij. FIG. 12 is a diagram showing gate voltages and signal voltages. Abscissa axes indicate time axes. Ordinate axes indicate voltage axes. The ith gate voltage is designated by the reference mark Yi, and a signal voltage input into the pixel Pij is designated by a reference mark Vij. Moreover, FIG. 13 shows the electric potential of each pixel electrode when the gate voltages and the signal voltages are applied to the respective pixels as shown in FIG. 12 at a write time and a holding action time. At a holding action time of a display image after the display state has substantially reached a desired gradation level and the write actions to all of the pixels have been completed, a certain period in the holding action period is divided into two or more periods, and the electric potential of the pixel electrodes is gradually attenuated. FIG. 12 shows one example of the attenuation performed by dividing a certain period in the holding action period into two periods, and FIG. 12 will be referred to while the description of the present embodiment is given more concretely. It is needless to say that the holding action period may be divided into two or more periods. In a state in which a gate voltage corresponding to the off voltage of the TFT is applied to the scanning lines of all of the rows, as shown in FIG. 12, a certain fixed voltage Vh1 larger than the off voltage and smaller than the on voltage is applied to the gate electrodes of the TFT's at the first period. At the next period, a certain fixed voltage Vh2 larger than the off voltage and smaller than the on voltage is applied to the gate electrodes of the TFT's. Thereby, as shown in FIG. 13, the attenuation of the absolute values of the potential differences between the first electrodes and the second electrode is performed faster than the attenuation in a case of according to a time constant at the time of off of the TFT and slower than the attenuation in a case of according to a time constant at the time of on of the TFT under the two step condition.

By the method described above, the influence of the residual DC at the time of a holding action of a display image of an electrophoresis display apparatus can be decreased similarly to the embodiment 1, and the holding characteristic can be improved.

Embodiment 4

In the present embodiment, after the completion of the actions in an arbitrary Ith frame in a holding action period in the embodiment 1, a gate voltage corresponding to the off voltage of the TFT is applied to the scanning lines 12 of all of the rows. In this state, a certain voltage larger than the off voltage and smaller than the on voltage is applied to the gate electrodes of the TFT's at the scanning lines of all of the rows. Thereby, the attenuation of the absolute values of the potential differences between the first electrodes and the second electrode is performed faster than the attenuation in a case of according to a time constant at the time of off of the TFT and slower than the attenuation in a case of according to a time constant at the time of on of the TFT.

By the method described above, the influence of the residual DC at the time of a holding action of a display image of an electrophoresis display apparatus can be decreased similarly to the embodiment 1, and the holding characteristic can be improved.

What is claimed is:

1. A method for driving a display apparatus having display memory property, said display apparatus including an electrode group composed of at least a first electrode and a second electrode, said method comprising the steps of:

applying a voltage for performing writing of an display image between said first electrode and said second electrode; and attenuating an absolute value of a potential difference between said first electrode and said second electrode in a term within a holding period of the display image, wherein said step of attenuating the absolute value of the potential difference between said first electrode and said second electrode is performed by performing an active matrix drive of said display apparatus, and at said step of attenuating the absolute value of the potential difference between said first electrode and said second electrode, the absolute value is attenuated over a plurality of frames of performing an active matrix drive of said display apparatus.

2. A method for driving a display apparatus according to claim 1, wherein a thin film transistor is used as a switching device to be connected to said first electrode of each pixel of said display apparatus.

3. A method for driving a display apparatus according to claim 1, wherein a thin film transistor is used as a switching device to be connected to said first electrode of each pixel of said display apparatus, and wherein at said step of attenuating the absolute value of the potential difference between said first electrode and said second electrode, the absolute value is attenuated by adjusting a gate voltage of said thin film transistor to leak a current through said thin film transistor in said term.

4. A method for driving a display apparatus according to claim 3, wherein at said step of attenuating the absolute value of the potential difference between said first electrode and said second electrode, said gate voltage is adjusted in two or more values.

5. A method for driving a display apparatus according to claim 1, wherein said display apparatus is an electrophoresis display apparatus including:

a fluid dispersion containing a liquid and a plurality of charged migration particles; and an electrode group composed of at least a first electrode and a second electrode for forming an electric field in said fluid dispersion by applying a voltage.

* * * * *

UNITED STATES PATENT AND TRADEMARK OFFICE

CERTIFICATE OF CORRECTION

PATENT NO. : 7,259,745 B2
APPLICATION NO. : 10/793125
DATED : August 21, 2007
INVENTOR(S) : Atsushi Hamaguchi It is certified that error appears in the above-identified patent and that said Letters Patent is hereby corrected as shown below:

Column 10, Line 65, change “an” to --a--.

Signed and Sealed this

Twenty-seventh Day of November, 2007

JON W. DUDAS
*Director of the United States Patent and Trademark Office*